United States Patent [19]

Stegmeier

[11] 3,968,191

[45] July 6, 1976

[54] METHOD OF SETTING TILE AND FORMING SWIMMING POOL DECK

[76] Inventor: William J. Stegmeier, 1021 C Shary Circle, Concord, Calif. 94520

[22] Filed: Sept. 6, 1974

[21] Appl. No.: 503,949

Related U.S. Application Data

[63] Continuation of Ser. No. 299,209, Oct. 20, 1972, abandoned.

[52] U.S. Cl. ..... 264/34; 52/169 R; 52/746; 249/DIG. 3; 264/35; 264/162

[51] Int. Cl.[2] ..... E04B 1/16; E04H 7/18

[58] Field of Search ..... 264/31, 34, 35, 162; 52/169, 742, 743, 744, 746; 4/172.18, 172.19, 172.21

[56] References Cited

UNITED STATES PATENTS 2,729,093 1/1956 Ridley ..... 264/31 X

*Primary Examiner*—Robert F. White
*Assistant Examiner*—Thomas P. Pavelko
*Attorney, Agent, or Firm*—C. Michael Zimmerman

[57] ABSTRACT

A method of setting tile along an upwardly extending wall of a swimming pool or the like, and for forming a concrete deck along the upper edge of such wall in overlying relation therewith. The tile-setting and deck-forming may be effected as a single-stage or multiple-stage process; and in either instance, a plurality of tile units are supported a spaced distance from the wall in side-by-side juxtaposition to form a generally horizontal row. The space intermediate the tile units and pool wall is filled with a mass of mortar which is maintained therein to cure and to bond the tile units to the wall. In a one-stage process, the mortar used to bond the tile to the wall is supplemented in sufficient quantity to provide the requisite concrete mass that cures into a deck overlying the upwardly extending pool walls. In a two-stage process, the concrete mass that cures to form the deck is poured after the mortar and as a separate operation.

15 Claims, 8 Drawing Figures

METHOD OF SETTING TILE AND FORMING SWIMMING POOL DECK

This is a continuation of application Ser. No. 299,209, filed Oct. 20, 1972, now abandoned.

This invention relates to a method of setting tile along an upwardly extending wall of a construction project such as a swimming pool or the like, and it relates more particularly to a method of setting tile and of molding a concrete deck along the upper edge of a swimming pool or like structure.

In constructing swimming pools, the technique now generally followed is to form the upwardly extending and bottom closure walls of the pool with concrete which may be poured into molds erected for this purpose but is more usually deposited by a gunnite process in which the cement, water, and aggregate are mixed at a nozzle and ejected under pressure against a prepared support or backing. After the concrete has cured sufficiently, the inner surfaces of the concrete that are intended to contain water are covered with a suitable finishing material, and a horizontal deck is provided at the top of the upwardly extending pool walls to form a walkway and drainage area about the pool, and to establish an esthetically attractive frame thereabout. The deck may be poured concrete and is often a cantilever deck that overhangs the pool walls.

Whereas in the past it was common to finish or face the water-containing concrete wall surfaces of a swimming pool with ceramic tile, material and labor costs today generally prohibit the overall use of tile facing, and a finishing coat of concrete (which is usually referred to as plaster and comprises an admixture of cement and fine aggregate) is used to face the concrete walls. However, it is desirable, if not necessary, to provide at least a single horizontal row of ceramic tile adjacent the upper edge portion of the side walls of a swimming pool at the elevation at which the water level in the pool is to be maintained. The reason therefor is that body oils collect along the water surface in a swimming pool and adhere to the pool walls with considerable tenacity at the water level, thereby making removal of such oils from the wall surfaces quite difficult. The hard, substantially impervious finish of glazed ceramic tile facilitates removal of such oils and other matter, and is advantageously used in a swimming pool at this location. Such use of tile has been found practicable because the costs of setting one such row of tile is not prohibitive with reference to the advantages attributable thereto.

The tile-setting procedure now universally followed is for a tile setter to locate the highest elevation along the pool wall, patch or fill the upper edge of the pool wall to bring it to this elevation (this is not always done but should be), and then nail a continuous horizontal ledger board to the wall a measured distance below such elevation. A suitable mortar is then prepared, spread along the upper edge portion (often referred to as a bond beam) of the concrete walls above the ledger board, and each tile block (or sheet or mosaic tile) is seated upon the ledger board and pressed into the mortar, care being taken to align each tile vertically and in planar relationship with those tiles adjacent thereto as well as horizontally. Evidently, this procedure is slow and time-consuming and therefore relatively expensive but, more importantly, it is often difficult to obtain the services of a qualified tile setter especially in remote areas so that unskilled labor must be used which more often then not results in workmanship that is not initially satisfactory or subsequently proves to be unsatifactory and therefore expensive to the contractor if the tile breaks loose and must be replaced.

Analogously, it is far too expensive in many cases to construct a pool deck by hand-setting coping along the edge and then laying tile or block outwardly from the coping to form a generally horizontal deck surface. As a result, poured concrete decks are used with increasing frequency, and very often "cantilever decks" (i.e., decks having an edge portion thereof freely overhanging the side walls of the pool in overlying relation with the water confined therewithin) are preferred because of their functional and esthetic advantages. It is necessary to provide mold forms to confine the mass of flowable concrete that cures to define a cantilever deck, thereby requiring a mold form and a means for supporting the same along the side walls of the pool adjacent the upper edge portions thereof.

Until quite recently, the universal practice in this latter respect has been to construct the requisite form by nailing appropriate strips of lumber to each other and to the pool side walls and, after the concrete poured against such form has cured, to remove the form and then set the necessary row of tile (in the manner previously described) along the side walls of the pool in underlying relation with the overhang of the cantilever deck. There have been some recent improvements in this reference which enable the tile to be set prior to pouring the cantilever deck which has obvious advantages; and in more specific terms, such improvements are disclosed in my pending patent application, Ser. No. 761,726, filed Sept. 23, 1968, now Patent No. Even with such improvements, the tile is nevertheless set by conventional techniques, and the deck is poured as a separate operation after the tile is set and the mortar bonding the same to the pool walls at least partially cured.

In view of all of the foregoing, an object of the present invention is to provide an improved method of setting tile along an upwardly extending wall of a building project such as a swimming pool or the like, which is quick, easy, does not require the services of skilled tile setters and, accordingly, is inexpensive. Another object of the invention is in the provision of an improved method of forming a cantilevered concrete deck along the upper edge of a swimming pool. Still another object is that of providing an improved method of setting tile along an upwardly extending wall of a swimming pool or the like and, as part of the same operation, forming a cantilever deck along the upper edge or bond beam of such pool.

Additional objects and advantages of the invention, especially as concerns particular features and characteristics thereof, will become apparent as the specification continues.

In general summary terms, the tile-setting method embodying the invention includes the step of supporting a plurality of tile units in side-by-side juxtaposition along the pool wall a spaced distance therefrom, and then pouring mortar into the space defined between the tile units and wall to fill the space and thereby bring the mortar into intimate contact with the facing tile and wall surfaces. The mortar is confined within this space until it cures to bond the tile units to the pool wall. In a two-stage process in which the cantilever deck is then constructed, a mold form is attached along the exposed surface of the tile units and concrete poured against the form and in overlying relation with the pool wall and bond beam at the upper end thereof so as to define the requisite deck when the concrete mass has cured. In a one-stage process in which the tile is set and the cantilever deck constructed as part of the same operation, the mold form is supported along with the tile units and the pouring of mortar into the space defined between the facing surfaces of the tile and wall is continued until the entire deck is poured Embodiments of the invention are illustrated in the accompanying drawings, in which FIGS. 1 through 6 and 8 are each diagrammatic broken vertical sectional views illustrating steps in the process, as follows:

Figure 1:
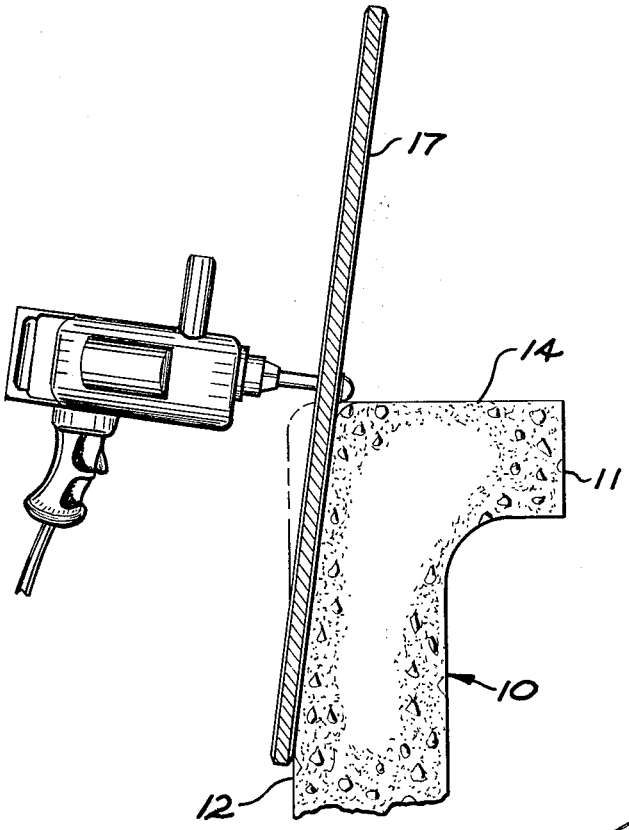
FIG. 1 illustrates the step of trimming the upper edge portion of a swimming pool wall.

As indicated hereinbefore, the tile-setting method embodying the present invention is adapted for use in setting tile along the upwardly extending or generally vertical walls erected in a construction project and, in particular, the upwardly extending walls of a swimming pool. Walls of this type are generally concrete and ordinarily equipped at the upper ends thereof with an integral section that extends laterally and is frequently referred to as a "bond beam". A wall of this type is illustrated in FIG. 1 and is denoted in its entirety with the numeral 10, and the bond beam at its upper end is designated with the numeral 11. As respects the present invention, the wall 10 may be essentially conventional and can be formed by any suitable construction process — a gunnite technique usually being employed. The inner surface of the wall 10 facing the interior of the pool to define the water-receiving container is identified with the numeral 12, and the upwardly facing surface of the bond beam 11 is denoted with the numeral 14.

Figure 2:
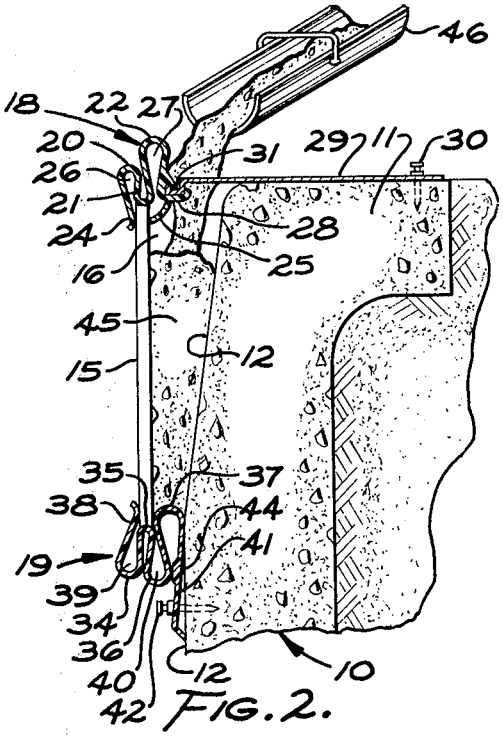
FIG. 2 illustrates the step of supporting a tile unit and pouring mortar to secure the same to the pool wall.

A row of tile units, usually ceramic, is secured to the wall adjacent the upper edge thereof, as heretofore explained, and one such tile is illustrated in FIG. 2 and is designated with the numeral 15. Tile of the type shown in FIG. 2 ordinarily take the form of rigid square-shaped blocks that are approximately six inches in length and width and may have a thickness of from about ½ to ⅜ of an inch although this may vary considerably from brand to brand. As respects the present invention, it is of no significance whether the blocks are square or rectangular, and the lengths and widths of the blocks may vary materially from the usual six-inch standard. For example, the blocks 15 could be rectangular as well as square-shaped, and the length and/or vertical dimensions thereof might be twelve inches, for example, rather than the dimensions noted.

The tile blocks 15 are adapted to be secured to the wall 10 by means of mortar which is poured into a cavity or space 16 define between the facing surfaces of the wall 10 and tile. Before the mortar is poured, it will usually be advantageous to first wet the facing surfaces of the wall and tile, and in many instances the inner surface of the tile will be brushed, dipped, or otherwise coated with a slurry of cement and water. Respecting the present invention, the surface preparation and mortar compositions used may be completely conventional. It may be of convenience to relieve the upper portion of the wall 10 along the inner surface 12 thereof to taper the latter outwardly and thereby enlarge the cavity 16 and entrance thereinto to facilitate pouring of mortar into the space or cavity, as is evident in FIG. 2. The such step of providing such relief is illustrated in FIG. 1 by trimming the surface of the wall, as by means of a cutting instrument such as saw apparatus 17 depicted in FIG. 1 as a rotatable saw disc driven by a hand-held tool.

The tile units 15 are supported along the upper edge of the wall 10 in side-by-side juxtaposition so as to form a horizontally disposed row thereof, and they are spaced from the wall so as to define the aforementioned cavity 16 therebetween. In the specific embodiment of the invention being considered, the tile units are supported by apparatus provided for this purpose which includes upper and lower support components 18 and 19, respectively, each of which is elongated and longitudinally extending and is adapted to be secured to the wall 10 so as to support the tile blocks 15 in side-by-side juxtaposition and substantially horizontal alignment. Each of the supports 18 and 19 is advantageously formed of a material that does not readily corrode or rust since they are used in a water-laden environment, and such supports may be formed of any of a number of synthetic plastic materials as, for example, polyvinyl chloride. Conveniently, this material will be extruded to provide the supports 18 and 19 in the configurations and with the characteristics shown.

The supports 18 and 19 are also somewhat resilient and flexible so as to grip and hold each tile unit 15 along the upper and lower edges thereof, and the supports are also bendable and flexible in transverse directions (i.e., generally normal to the plane of the wall 10) so as to enable each support to follow at least gradual inside and outside curves that may be formed along the wall 10 of a swimming pool, especially in pools of free-form design. This desirable bending attribute of each support is enhanced by increasing the ratio of the vertical dimension to the transverse dimension thereof, especially as concerns each convolution, as will be noted hereinafter.

The upper support 18 comprises a plurality of successive convolutions formed integrally with each other and running substantially from one side of the support to the other. In the form shown, there are essentially three serpentine-like convolutions respectively denoted with the numerals 20, 21 and 22. The convolution 21 together with the downwardly extending lips 24 and 25 bordering the same define a downwardly facing seat constructed to receive the upper edge of the tile unit 15 therein, as shown. The convolution 21 establishes the inner terminus of the seat and may positively engage the upper edge of the tile unit 15, although this will depend on the precise spacing between the supports 18 and 19. The lips 24 and 25 are adapted to substantially engage the opposite faces of the tile unit 15, and the support 18 has sufficient resilience or flexibility so as to permit relative transverse displacements between the lips for the purpose of accommodating tile units of different thickness. The convolutions 20 and 22 provide recesses 26 and 27, respectively, for purposes to be particularized hereinafter.

The upper support 18 is also equipped with an attachment section 28 generally adjacent the lip 25 and, in the form shown, the attachment section 28 is essentially continuous and runs from end to end of the support. The attachment section 28 is adapted to cooperate at spaced apart locations therealong with a plurality of anchor straps 29 fixedly secured to the wall 10 such as by being fastened by nails 30 to the bond beam 11 along the upper surface 14 thereof. Each strap 29 is provided adjacent an end thereof with a fastener element 31 adapted to interlockingly engage the attachment section 28 and thereby secure the support 18 to the wall 10. The fastener 31 has a somewhat J-shaped configuration so as to seat within the complementary configuration of the attachment section 28. The inherent resilience of the support 18 and cooperative, interlockingly engageable elements of the attachment section and fastener effect an adequate and appropriate mounting for the support and by means of which it is secured to the wall 10. Any number of anchor straps 29 may be used depending upon the individual preferences of the contractor and the requirement for maintaining a proper dimensional relationship between the support 18 and wall 10 along the length thereof so that the successive tile units 15 have the requisite orientation (usually vertical).

The lower support 19 is quite similar to the upper support 18 and comprises a plurality of successive convolutions formed integrally with each other and running substantially from one side of the support to the other. In the form shown, there are essentially four serpentine-like convolutions respectively denoted with the numerals 34, 35, 36 and 37. The convolution 35 together with the upwardly extending lip 38 and convolution 37 bordering the same define an upwardly facing seat constructed to receive the lower edge of a tile unit therein, as shown. The convolution 35 establishes the inner terminus of the seat and may positively engage the lower edge of the tile unit 15. The lip 38 and convolution 37 are adapted to substantially engage the opposite faces of the tile unit 15, and the support 19 has sufficient resilience or flexibility so as to permit relative transverse displacements between the lips for the purpose of accommodating tile units of different thickness. The convolutions 34 and 36 provide recesses 39 and 40, respectively, for purposes to be particularized hereinafter.

The convolution 37 of the lower support 19 defines a spacer adapted to separate the tile-receiving seat from the surface 12 of the wall 10, and therefore to separate the tile unit 15 therefrom by a relatively determinant transverse distance generally equivalent to the width of the convolution. Accordingly, the spacer convolution 37 is located intermediate the wall face 12 and tile unit 15 and resiliently engages the lower edge of the tile, as heretofore explained. The convolution 37 extends downwardly along the terminal end thereof to form a depending section or portion 41 adapted to be removably secured to the wall by a plurality of nails or comparable fasteners 42 which can be driven through the section 41 and into the wall, as illustrated in FIG. 2.

The convolution 37 and depending section 41 thereof have a transversely projecting stop or abutment 44 extending therealong which is located in transverse alignment with the convolution 36 adjacent its lower end. The stop 44 may comprise a plurality of longitudinally spaced protuberances, or it may be essentially a continuous component running from end to end of the lower support, as shown. The abutment is operative to engage the facing surface of the convolution 36 and thereby limit inward movement of such convolution together with the associated convolutions 34 and 35 under the weight of the tile units 15 seated upon the convolution 35. Should further details be desired concerning the supports 18 and 19 and straps 29, they are presented in my copending patent application filed concurrently herewith, Ser. No. such details being incorporated herein by this reference thereto.

The tile units 15 are inserted into the seats respectively defined by the supports 18 and 19 and are supported thereby in side-by-side juxtaposition along the wall 12 in spaced relation therewith. The cavity or space 16 is exaggerated in transverse dimension in each of the Figures for illustrative purposes and is actually quite restricted, and at the bottom thereof the spacer 37 may define a transverse dimension approximating ½ of an inch. The relief afforded along the upper edge of the wall 10 by the trimming operation in many cases may not exceed about ¼ of an inch. In any case, the space is filled with a mass of mortar 45 which may be poured or otherwise directed thereinto, as from a chute 46 as shown in FIG. 2. The mass of mortar 45 intimately contacts the facing surfaces of the tile units 15 and wall 10 and, when cured, bonds one to the other. It will be observed that the mass of mortar 45 is confined within the space 16 as it cures, the lateral or transverse constraint being provided by the tile units 15 and wall 10, and the lower constraint being supplied by the support 19 and spacer 37 thereof. The mortar 45 as to its ingredients and proportions may be completely standard.

Figure 3:
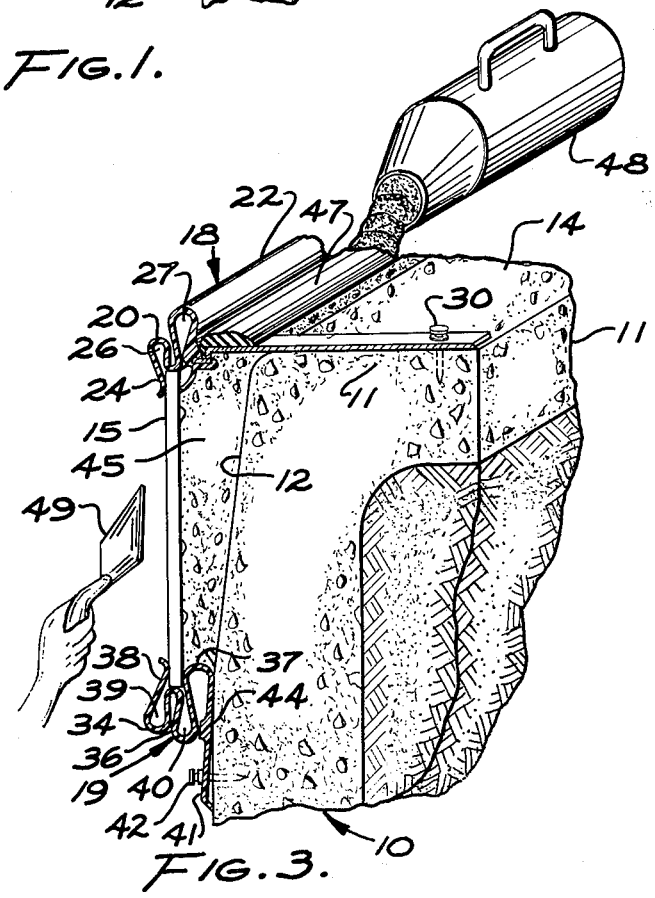
FIG. 3 illustrates the step of laying a mastic barrier along the upper surface of the mortar and of grouting the tile units.

Advantageously, a mastic material 47 is laid along the juncture of the upper support 18 and mortar mass 45 to augment the water barrier otherwise defined by the support. The mastic 47 may be spread as a viscous liquid from a tube or other container 48. A number of mastics may be used, and a specific example of one found satisfactory is silicone rubber which cures quickly and adheres readily to both the mortar 45 and support 18. The mastic 47 is usually applied after the mortar has at least partially cured, and the spaces between the tile units 15 are usually grouted before the mortar has completely cured. The grouting step is a conventional operation performed manually, and it is illustrated in FIG. 3 by the hand-held trowel 49.

Figure 4:
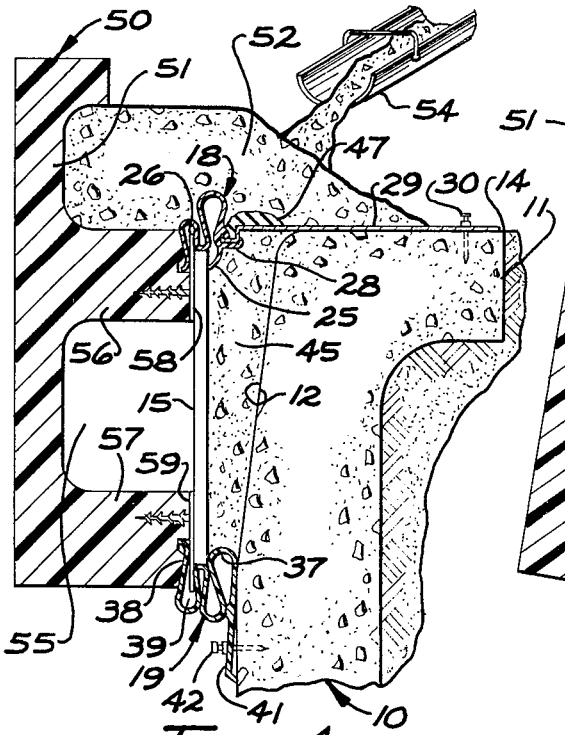
FIG. 4 illustrates the step of supporting a mold form and of pouring concrete to construct a cantilever deck.

As shown in FIG. 4, a mold form 50 is supported along the exposed face of the tile units 15 so that a configurated or shaped portion 51 of the form extends above the wall 10 and upper surface 14 of the bond beam and is adapted to confine a mass of concrete poured thereagainst so as to define the inner edge thereof and enforce a predetermined configuration thereon. Such mass of concrete cures to form a deck along the upper edge of the pool wall 10 with a portion of the deck overhanging the wall in cantilever fashion. The concrete mass which cures to form the deck is denoted with the numeral 52, and it may be poured in a conventional manner, as indicated by the trough 54. Although the mold form 50 can be attached along the tile units 15 at different times, depending upon the exact procedure being followed, it may be placed (as suggested by comparing FIGS. 3 and 4) after the tile units are grouted and after the mastic 47 has cured.

The form 50 is an elongated component provided in lengths convenient to handle (eight-foot lengths, for example), and the particular form shown is fabricated from a synthetic plastic foam such as polystyrene. A plurality of mold form sections are disposed in end-to-end relation to define a continuous form about the upper perimetric edge portion of a pool, and the form sections are sufficiently flexible or bendable to accommodate and conform to gradual inside and outside bends or curves along the edges of the pool as is often found in freeform configurations. The form 50 may have a large longitudinally extending opening 55 therein to reduce material requirements, and such opening defines or is bordered by spaced feet or ribs 56 and 57 which have outer free surfaces lying essentially within the same plane. Form sections of this type are disclosed in detail in my aforementioned pending application, Ser. No. 761,726, and reference may be made to such application for these details.

Each form section 50 is removably supported along the wall 10, and such support is effected by releasable interconnection with the aforementioned supports 18 and 19 and, more particularly, by cooperative interconnection of a plurality of longitudinally spaced upper latch plates 58 carried by the upper rib 56 and longitudinally spaced lower latch plates 59 carried by the lower rib 57 with the supports 18 and 19. Each of the plates 58 and 59 is a generally square-shaped element fixedly secured to the respectively associated ribs 56 and 57 by one or more barbed nail-like fasteners or projections 60 and 61, respectively, fixedly secured to the associated plate and embedded in the adjacent rib, as shown in the drawings. An adhesive may also be used intermediate the contiguous surfaces of the ribs and plates to further enhance the attachment therebetween. The plates 58 and 59 and fasteners 60 and 61 thereof may be integral, and these components may be formed of a synthetic plastic material such as polyvinyl chloride.

Figure 5:
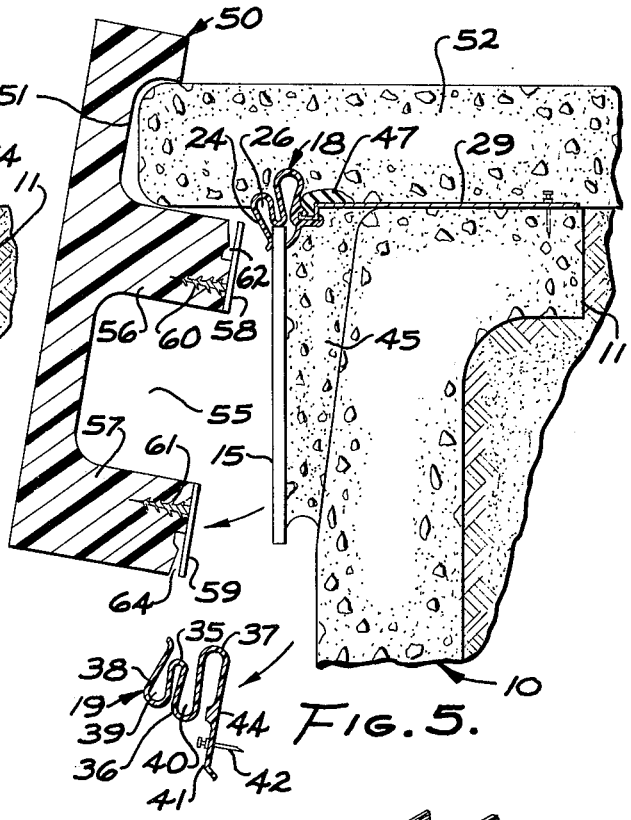
FIG. 5 illustrates the steps of removing the mold form and lower support component for the tile units at the completion of the process.

As shown best in FIG. 5, the rib 56 has an upwardly opening groove or channel 62 along the upper edge of the plate 58 and, correspondingly, the rib 57 has a downwardly facing groove or channel 64 along the lower edge of the plate 59. The grooves 62 and 64 are adapted to receive the lips 24 and 38 therein when the upper and lower edge portions, respectively, of the latch plates 58 and 59 are inserted behind the lips 24 and 38 and into the assembled recesses 26 and 39, as shown in FIG. 4. The latch plates 58 and 59 are provided along the form section 50 in sufficient numbers and at appropriate intervals to supply the requisite degree of support therefor in association with the components 18 and 19.

The inherent flexibility of the support elements 18 and 19 permit insertion and removal of the latch plates 58 and 59 into and from the recesses 26 and 39; and after the concrete mass 52 has been poured and cured sufficiently to be self-sustaining, the form sections 50 are removed, as illustrated in FIG. 5. The form sections can be carefully removed and preserved for reuse, but the form sections shown are not intended to be reused since they are relatively inexpensive and may be destroyed in the removal process. The lower support 19 is also removed, as shown in FIG. 5, and can be preserved for reuse. In this respect, the nails or fasteners 42 are simply withdrawn from the concrete wall 10 to release the support therefrom.

Thus, the over-all sequence of steps or process illustrated in FIGS. 1 through 5 comprises setting a row of tile units 15 along the top edge portion of an upwardly extending side wall 10 of a swimming pool and of thereafter forming a concrete deck along the top of such wall in overhanging relation therewith and with the row of tiles. The process includes supporting the tile units in side-by-side juxtaposition a spaced distance from the pool wall, and filling the space with mortar and of confining the mortar within the space until cured so as to bond the tile units to the wall. The process further includes the steps of supporting a mold form along the exposed face of the tile units and of pouring a moldable mass of concrete along the upper edge of the wall where it is confined by the mold form which imposes a particular configuration upon the concrete mass so that it cures with such shape which is thereby preserved as a part of the concrete deck. The form is then removed, and the lower support component used to maintain the tile units at the desired elevation and in horizontal alignment is also removed so that the remaining surface area of the pool wall can be finished in the usual manner. The upper edge of the swimming pool wall along the bond beam thereof may be relieved or trimmed as a preparatory step to facilitate flow of mortar into the space between the tile units and wall, as illustrated in FIG. 1, and a mastic 47 may also be laid along the juncture of the upper surface 18 and mortar 45 to seal such juncture prior to constructing the deck 52.

Figure 6:
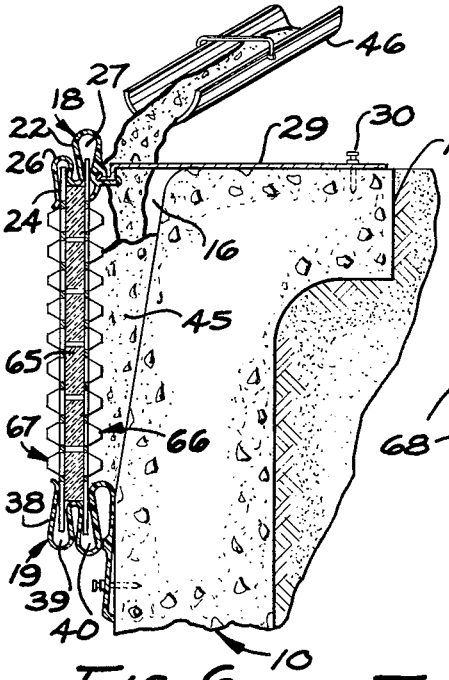
FIG. 6 illustrates a somewhat modified procedure in which the tile units are flexible strips of mosaic tile, the view showing the steps of supporting such tile unit and of pouring concrete.

The tile units 15 shown in FIGS. 2 through 5 are rigid tile blocks which are therefore self-sustaining. As previously noted, however, the tile units may occasionally be flexible sheets of mosaic tile constituting a plurality of relatively small pieces of tile adhesively attached to a very porous fabric backing. Such tile units are not self-sustaining and must be held or rigidified until they are bonded to the wall 10 so as to prevent transverse bending or deformation of the sheets. An arrangement for accomplishing this result is illustrated in FIGS. 6 and 7.

First, however, it may be noted that the usual flexible webbing to which the small mosaic tiles are adhesively secured to facilitate handling has not been shown so as to simplify the illustration and avoid pictorial complexity. The mosaic tile sheet illustrated is denoted in its entirety with the numeral 65, and it is shown to comprise six generally horizontal rows of substantially identical tile pieces with each row being spaced from those adjacent thereto so as to accommodate grout, all as is well known. The flexible sheet 65 is rigidified or reinforced by backing structure comprising, in the form shown, two substantially identical backing strips or components 66 and 67 respectively disposed along opposite faces of the tile sheet. Although the backing components 66 and 67 can differ one from the other, they are identical in the form shown and may be cut or taken from the same stock material.

Figure 7:
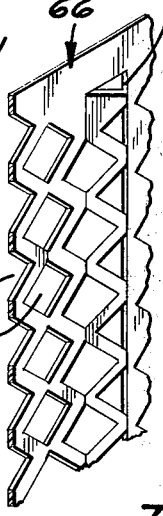
FIG. 7 is a broken perspective view of a backing component used with mosaic tile units.

As is shown best in FIG. 7, the backing components are for the most part planar and are provided with a plurality of apertures or openings 68 therealong which in the aggregate constitute a large surface area through which the inner surface of the tile sheet 65 is exposed for contact with the mortar used to secure such sheet to the wall 10. In more specific terms, the aggregate area defined by the openings 68 should be as large as practicable without so weakening the backing component that it cannot afford adequate support for the tile sheet 65. By way of example, the aggregate area of the openings 68 is of the order of, and preferably in excess of, 50% of the total surface area of the component 66.

The backing component 66 is stiffened or strengthened by transverse ribs or corrugations 69 spaced longitudinally therealong. Such strengthening ribs in the form shown have a generally V-shaped configuration although this shape is in no sense mandatory. The backing strip 66 is formed of a material that does not corrode or rust since materials having such characteristics are undesirable because rust has a tendency to bleed through grout used to fill the spaces between the small mosaic tiles. Many different materials can be used to form the backing strip 66, and various synthetic plastics are very suitable therefor - a specific example being polyvinyl chloride. Further details concerning the backing components may be found in my aforementioned, concurrently filed patent application, Ser. No.

As is most evident in FIG. 6, the backing strips 66 and 67 have upper and lower edge portions respectively receivable within the transversely spaced recesses 26 and 27 of the upper support 18 and in the transversely spaced recesses 39 and 40 of the lower support 19. These recesses have restricted mouths or entrances thereinto formed by the converging-diverging configurations of the successive convolutions associated therewith; and as a result, the upper edge portions of the backing strips tend to be resiliently confined within such recesses by the restricted mouths associated therewith, as shown in FIG. 6. Accordingly, the backing strips or components 66 and 67 are held by the supports 18 and 19 in substantially contiguous juxtaposition with the mosaic sheet 65 so as to prevent transverse collapse thereof in either direction.

The sheets 65 together with the backing components 66 and 67 may be arranged in the relative positions shown in FIG. 6 in any way most convenient to the workman providing the installation; and as an example, the component 66 might first be placed in position with the upper and lower edge portions thereof seated within the recesses 27 and 40. Next, the sheets 65 are placed along the backing component 66 and are held in place until the backing component 67 is placed in supporting relation therealong with its upper and lower edge portions seated within the recesses 26 and 39.

Thereafter, mortar is poured into the space 16 intermediate the facing surfaces of the sheets 65 and wall 10, and the mortar flows through and into the various openings 68 in the component 66 to contact the mosaic tiles and thereby anchor the same to the wall 10. After sufficient curing, the exposed backing component 67 and the lower support 19 are removed and preserved for reuse, and the tile is grouted as heretofore explained. The component 66, it will be apparent, becomes a permanent part of the installation.

The supports 18 and 19 and backing structure 66, 67 may be provided in any lengths desired and they may differ in length one from another. As an example of typical lengths, each of these members may be sold in eight-foot segments. The backing components will have a vertical height slightly in excess of 6 ins., for standard tile dimensions, and the gauge thereof in one specific instance approximates 0.050 of an inch. The gauge of the material used for the supports 18 and 19 in a typical embodiment thereof is approximately 0.080 of an inch. It will be evident that these exemplary dimensions may vary considerably.

After the backing component 67 is removed and the tile sheets 65 grouted, as heretofore explained with particular reference to FIG. 3, the mold form 50 is mounted and the concrete mass 52 poured to form a cantilever deck, all as previously described and shown in FIG. 4. A mastic strip may be applied to the junction of the upper support 18 and mortar 45 before the concrete deck is poured, all as previously explained. After the deck has cured, the mold form 50 and lower support 19 are removed, as illustrated in FIG. 5 and heretofore explained.

Figure 8:
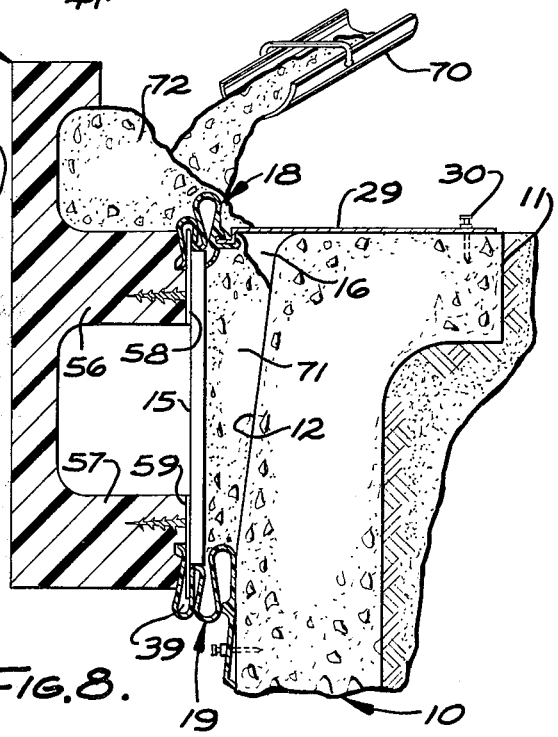
FIG. 8 illustrates a further modified procedure in which the tile units and mold form are supported concurrently, and in which the mortar and cantilever deck are poured concurrently as part of the same operation.

The tile-setting and deck-forming process previously described is a two-stage process in which the tile is bonded to the wall 10 by a mass of mortar 45, and after the mortar is cured, the concrete deck 52 formed. Such process also described mounting of the mold form 50 as occurring after the mass of mortar 45 has been poured and at least partially set and after the tile has been grouted. It will be apparent that the mold form 50 could be attached prior to pouring the mortar 45, in which case the tile would be grouted after the deck 52 has been poured and cured sufficiently that the mold form 50 can be removed to expose the outer face of the tile units for grouting. In FIG. 8 an essentially one-stage process is depicted in which the mass of mortar and concrete deck are poured as a part of the same operation. In this procedure, the upper and lower supports 18 and 19 are secured to the wall 10 as previously explained, and the tile units are inserted into the space respectively defined by the supports. A rigid tile unit 15 is illustrated in FIG. 8, but flexible tile units 65 of the type shown in FIG. 6 may be employed — it being understood that with such flexible sheets reinforcing components 66 and 67 will necessarily be used therewith. The mold form 50 is then mounted by inserting the latch plates 58, 59 thereof into the recesses 26 and 30 of the supports, the mold form either directly engaging the outer face of the tile units 15 or backing component 56, as the case may be.

Next, a mass of concrete is poured continuously, as indicated by the chute 70, so as to fill the space 16 with a mortar mass 71 and at the same time to provide a sufficient body of concrete 72 adequate to cure into the desired cantilever deck. The mortar mass 71 completely fills the space 16 so as to intimately contact the facing surfaces of the units 15 and pool wall so as to bond one to the other, as previously described. When the composite mass 71, 72 has cured sufficiently to be self-sustaining, the mold form 50 and lower support 19 are removed, as shown in FIG. 5 and explained previously. Thereafter, the tile units will be grouted as illustrated in FIG. 3.

As previously noted, the tile blocks 15 together with the pool wall 10 are used as part of the form structure by means of which the mass of mortar 45 is confined until it hardens sufficiently to become self-sustaining and attached both to the pool wall and to the tile blocks. Although standard mortar compositions may be used, as noted hereinbefore, fast-setting mortar is desirable for purposes of minimizing shrinkage of the mortar because shrinkage thereof tends to contract the same away from adjacent surfaces and particularly the surface of the tile block 15. The addition of accelerators such as calcium stearate to concrete or mortar to effect rapid setting thereof is known in the art and need not be discussed in detail herein.

Trimming of the upper edge portion or bond beam of the pool wall may be effected either before or after the concrete has cured, and in the latter case mechanism used for cutting or trimming concrete may be employed, and it generally takes the form of a wheel-equipped carriage that can be manually moved or pushed along the upper surface 14 of the bond beam as the cutting element trims the corner portion thereof. It might be observed that trimming the upper inner corner portion of the bond beam is advantageous from the point of view of pool construction because it is difficult using a gunnite process to form such corner portion accurately and with adequate strength because of the tendency of the concrete to spatter as it is blown against such corner portion. It will be apparent that any trimming of the bond beam will be limited in depth to the placement of the steel reinforcing (not shown) used to reinforce substantially all pool walls.

Although the tile blocks are spaced from the pool wall by a distance sufficient to enable an adequate mass of mortar to be poured therebetween, the lower edge portions of the tile blocks are generally positioned in relatively close proximity to the wall, as previously explained. It will be evident that the invention is applicable to any wall surface including a generally horizontal surface although its general utility is most evident in association with vertically extending walls, and the term "upwardly extending wall" has been used herein in a generic sense. It may also be observed that as respects the mosaic tiles 65, at least in certain instances elimination of the inner reinforcing component 66 may nevertheless result in such mosaic sheets being adequately supported by the outer component 67. In this respect, it will be apparent that the mass of mortar 45 poured behind the mosaic sheets will tend to displace the same outwardly against the outer support component 67 which of itself may be then adequate to maintain the orientation and disposition of the mosaic sheets until the mortar mass cures. As previously noted, the mastic 47 may be a synthetic rubber-like material, polyurethane liquid being a specific example thereof. Also, the mold forms 50 may be fabricated of expanded polystyrene which is often referred to in the art as "bead board".

A single or unitary pour of the mortar and concrete masses 45 and 52 has the mechanical advantage of the composite mass being monolithic, and it may be integrated with the bond beam if desired by steel reinforcing bars (e.g., reentrant bars) provided for this purpose. In certain instances such integration may not be advantageous and separation of the mortar and concrete masses by independent pours preferred. An example of this latter situation is one in which the deck of a pool is to be permitted to exhibit thermal displacements relative to the bond beam 11 and tile 15 (or 65) secured thereto. The resilient mastic 47 and resilient support 18, especially the convolutions thereof, both individually and in concert cushion the tile from the deck by establishing a resilient buffer therebetween. Coincident pouring of the mortar and concrete masses need not occur as a continuous uninterrupted operation, and the material (i.e., mortar and concrete) need not be identical. Accordingly, a switch from one material to another may be desirable, and there can be a time separation between the mortar and concrete pours as long as the time separation is not so great that the mortar cures to a wholly independent integer.

While in the foregoing specification embodiments of the invention have been set forth in considerable detail for purposes of making a complete disclosure thereof, it will be apparent to those skilled in the art that numerous changes may be made in those details without departing from the spirit and principles of the invention.

What is claimed is:

1. In a method of forming a side wall for a swimming pool or the like, the steps of: forming an upwardly extending concrete wall, thereafter temporarily supporting a plurality of tile units in side-by-side juxtaposition along said wall in spaced relation therewith to define a cavity having an accessible open top, substantially filling said cavity through its open top intermediate said plurality of tile units and the facing surface of said previously formed wall with a mass of mortar while said tile units are temporarily supported along said wall to bring said mortar into intimate bonding contact with the facing surfaces of said tile units and wall, maintaining said mortar mass within said cavity to enable said mortar to bond said tile units to said wall, thereafter releasing said temporary support of said tile units along said wall whereby said tiles are supported thereafter by said concrete wall, pouring a mass of concrete in overlying relation with said wall along the upper edge thereof to overhang said tile units, and maintaining said concrete mass in such overlying relation to cure and thereby define a cantilever deck along said wall.

2. The method of claim 1 in which the step of pouring said concrete mass is effected as a separate step occurring subsequent to filling said space with said mortar mass.

3. The method of claim 1 in which the step of pouring said concrete mass occurs substantially coincident with filling said cavity with said mass of mortar to define essentially a one-step operation therewith.

4. The method of claim 1 in which each of said tile units comprises a sheet of mosaic tiles, and wherein said step of supporting said plurality of tile units includes constraining each of said mosaic tile units against transverse displacements thereof in a direction away from said wall.

5. The method of claim 4 wherein said step of temporarily supporting said plurality of tile units also includes constraining each of said mosaic tile units against transverse displacements in a direction toward said wall.

6. In a method of forming a side wall for a swimming pool or the like, the steps of: forming an upwardly extending concrete wall, thereafter temporarily supporting a plurality of tile units in side-by-side juxtaposition along said wall in spaced relation therewith to define a cavity having an accessible open top, substantially filling said cavity through its open top intermediate said plurality of tile units and the facing surface of said previously formed wall with a mass of mortar while said tile units are temporarily supported along said wall to bring said mortar into intimate bonding contact with the facing surfaces of said tile units and wall, maintaining said mortar mass within said cavity to enable said mortar to bond said tile units to said wall, thereafter releasing said temporary support of said tile units along said wall whereby said tiles are supported thereafter by said concrete wall, securing a mold form along said tile units with a configurated portion projecting above the elevation thereof and inwardly of said wall, and pouring a concrete mass along the upper edge of said wall and into the configurated portion of said mold form so as to overlie said tile units, said concrete mass upon curing defining a cantilever deck overhanging said tile units.

7. The method of claim 6 in which the step of pouring said concrete mass is effected as a separate step occurring subsequent to filling said space with said mortar mass.

8. The method of claim 7 in which the step of securing said mold form along said tile units is effected after said space is filled with said mass of mortar.

9. The method of claim 8 including the further step of trimming said wall adjacent the upper edge portion thereof prior to supporting said tile units in spaced relation therewith.

10. The method of claim 6 in which the step of pouring said concrete mass occurs substantially coincident with filling said cavity with said mass of mortar to define essentially a one-step operation therewith, said mold form being secured along said tile units prior to filling said cavity with said mass of mortar and pouring said concrete mass.

11. The method of claim 10 including the further step of trimming said wall adjacent the upper edge portion thereof to remove concrete therefrom prior to temporarily supporting said tile unit in spaced relation therewith to enlarge the cavity otherwise defined between said wall and tile units.

12. In a method of forming a side wall for a swimming pool or the like, the steps of: forming an upwardly extending concrete wall, thereafter temporarily providing an elongated support having a seat extending therealong and securing the support to said wall, inserting a horizontal edge portion of a plurality of tile units in side-by-side juxtaposition along said wall in spaced relation therewith to define a cavity having an accessible open top, substantially filling said cavity through its open top intermediate said plurality of tile units and the facing surface of said previously formed wall with a mass of mortar while said tile units are temporarily supported along said wall to bring said mortar into intimate bonding contact with the facing surfaces of said tile units and wall, maintaining said mortar mass within said cavity to enable said mortar to bond said tile units to said wall, thereafter releasing said temporary support of said tile units along said wall whereby said tiles are supported thereafter by said concrete wall, securing a mold form to said elongated support along said tile units with a configurated portion projecting above the elevation thereof and inwardly of said wall, and pouring a concrete mass along the upper edge of said wall and into the configurated portion of said mold form so as to overlie said tile units, said concrete mass upon curing defining a cantilever deck overhanging said tile units.

13. In a method of forming a side wall for a swimming pool or the like, the steps of: forming an upwardly extending concrete wall, thereafter temporarily supporting a plurality of tile units in side-by-side juxtaposition along said wall in spaced relation therewith to define a cavity having an accessible open top, substantially filling said cavity through its open top intermediate said plurality of tile units and the facing surface of said previously formed wall with a mass of mortar while said tile units are temporarily supported along said wall to bring said mortar into intimate bonding contact with the facing surfaces of said tile units and wall, maintaining said mortar mass within said cavity to enable said mortar to bond said tile units to said wall, thereafter releasing said temporary support of said tile units along said wall whereby said tiles are supported thereafter by said concrete wall; and wherein said step of temporarily supporting said plurality of tile units includes providing a pair of said elongated supports respectively secured to said wall in spaced apart relation and respectively defining downwardly facing and upwardly facing seats, each of said tile units having the upper and lower horizontal edge portions thereof respectively disposed within said seats so as to be supported in spaced relation with said wall as aforesaid.

14. The method of claim 13 including the further steps of securing a mold form to each of said elongated supports and along said tile units with a configurated portion projecting above the elevation thereof and inwardly of said wall, and pouring a concrete mass along the upper edge of said wall and into the configurated portion of said mold form so as to overlie said tile units, said concrete mass upon curing defining a cantilever deck overhanging said tile units.

15. The method of claim 13 in which each of said tile units is a mosaic tile sheet, and including the further step of providing a relatively stiff backing structure and securing the same to said elongated support along the face of said mosaic tile units most remote from said wall to constrain the tile units against transverse displacements in a direction away from said wall.

* * * * *